United States Patent [19]

Hayashi et al.

[11] Patent Number: 4,925,394

[45] Date of Patent: May 15, 1990

[54] CERAMIC-COATED TERMINAL FOR ELECTRICAL CONNECTION

[75] Inventors: Kyozo Hayashi; Seiji Kawamura; Hirosaka Ikeda, all of Osaka, Japan

[73] Assignee: Sumitomo Electric Industries, Ltd., Osaka, Japan

[21] Appl. No.: 290,415

[22] PCT Filed: Dec. 28, 1987

[86] PCT No.: PCT/JP87/01048

§ 371 Date: Dec. 15, 1988

§ 102(e) Date: Dec. 15, 1988

[87] PCT Pub. No.: WO88/08626

PCT Pub. Date: Nov. 3, 1988

[30] Foreign Application Priority Data

Apr. 23, 1987 [JP] Japan ..... 62-102781

[51] Int. Cl.[5] ..... H01R 13/00

[52] U.S. Cl. ..... 439/86; 439/886

[58] Field of Search ..... 439/86, 886

[56] References Cited

U.S. PATENT DOCUMENTS

| | | | |
|---|---|---|---|
| 2,193,294 | 3/1940 | Osenberg | 439/886 |
| 2,379,567 | 7/1945 | Buchanan | 439/886 |
| 3,920,172 | 11/1975 | Rhee | 439/86 |

FOREIGN PATENT DOCUMENTS

| | | |
|---|---|---|
| 49-20128 | 5/1974 | Japan . |
| 51-27853 | 8/1976 | Japan . |
| 58-164115 | 9/1983 | Japan . |

*Primary Examiner*—Joseph H. McGlynn

*Attorney, Agent, or Firm*—Cushman, Darby & Cushman

[57] ABSTRACT

A ceramic-coated terminal for electrical connection wherein an electrically conductive ceramic coating layer is provided on surface of the base material of the terminal and an electrically conductive intermediate layer is optionally provided between the base material and the electrically conductive ceramic coating layer, which terminal has good mechanical properties and durability.

5 Claims, 1 Drawing Sheet

CERAMIC-COATED TERMINAL FOR ELECTRICAL CONNECTION

FIELD OF THE INVENTION

The present invention relates to a ceramic-coated terminal which is used for electrical connection.

BACKGROUND ART

Hitherto, a terminal for electrical connection comprises a base material made of a copper-based alloy and a plated layer which is coated on the base material and made of tin (Sn), a solder, nickel (Ni), gold (Au), silver (Ag) or the like selected according to service conditions.

For example, tin which is cheap is plated on the terminal for electrical connection to improve corrosion resistance of the terminal. Gold which is hardly oxidized is plated on the terminal for electrical connection, when a slight electrical current passes through the terminal for electrical connection. It is essential to plate gold, particularly in the case of the terminal which is used in a severe environment, for example, in an outdoor or under a hood of automobile in which a slight electrical current is treated.

However, the tin-plating has such a problem that it has poor reliability since the terminal for electrical connection may be corroded when used for a long time. The gold-plating has such problems that it is expensive and that it has inferior mechanical properties such as abrasion resistance.

OBJECT OF THE INVENTION

An object of the present invention is to provide a terminal for electrical connection whereby the above problems are solved.

CONSTITUTION OF THE INVENTION

The first aspect of the present invention resides in a ceramic-coated terminal for electrical connection characterized in that an electrically conductive ceramic coating layer is provided on a surface of a base material of the terminal.

The ceramic-coated terminal for electrical connection according to the present invention may have an electrically conductive intermediate layer between the base material and the electrically conductive ceramic coating layer.

Therefore, the second aspect of the present invention resides in a ceramic-coated terminal for electrical connection wherein an electrically conductive ceramic coating layer is provided on a surface of the terminal, characterized in that an electrically conductive intermediate layer is provided between a base material of the terminal and the electrically conductive ceramic coating layer.

Preferably the base material is made of an electrically conductive material, for example, a copper alloy such as brass or an iron-containing copper alloy, or steel. The base material is not necessarily made of the electrically conductive material. Rather, it may be made of, for example, a resin or a ceramic.

The electrically conductive ceramic coating layer is made of an electrically conductive ceramic, for example, at least one selected from the group consisting of titanium carbide, titanium nitride, tungusten carbide, tungusten nitride, zirconium carbide, zirconium nitride, chromium carbide and chromium nitride.

The electrically conductive intermediate layer, which is optionally present, may be made of any metal, preferably at least one selected from the group consisting of nickel, copper, chromium, silver, gold, nickel/-chromium, copper/nickel and copper/nickel/-chromium.

The electrically conductive intermediate layer and the electrically conductive ceramic coating layer have a thickness which varies with, for example, the kind of the used base material and service conditions. Usually, the electrically conductive ceramic coating layer has a thickness of a several micrometers.

The electrically conductive intermediate layer can be formed on the base material by any plating method such as an electroplating method or a vacuum deposition method. The electrically conductive ceramic coating layer can be formed on the electrically conductive intermediate layer or the base material by a spattering method, a CVD method, a plasma CVD method or an ion palating method.

For example, when brass is used as the base material, nickel, copper or chromium is plated on surface of the base material to form the electrically conductive intermediate layer. Then, the electrically conductive ceramic such as titanium nitride, titanium carbide, tugusten nitride or tungusten carbide is coated to form the electrically conductive ceramic coating layer. Preferably the material of the electrically conductive intermediate layer is a metal which can prevent migration of a zinc component in the base material, and has high hardness and good heat resistance.

When steel is used as the base material, copper plating is plated on the base material to form the electrically conductive intermediate layer which increases the electrical conductivity. Since the base material has high hardness, the metal of the intermediate layer may be soft. Then, the electrically conductive ceramic coating layer is formed.

BRIEF EXPLANATIONS OF THE DRAWINGS

The present invention will be illustratively explained with reference to the accompanying drawings. The present invention, of course, is not limited to the embodiments of the drawings.

Figure 1:
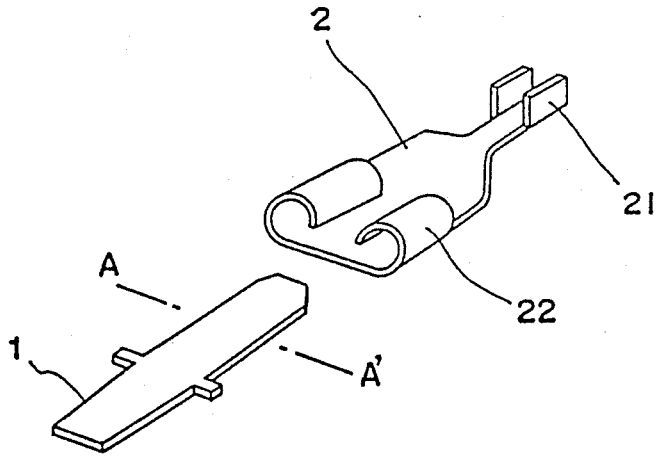
FIG. 1 is a perspective view of a male tab and a female terminal representing one embodiment of the terminal for electrical connection according to the present invention.

FIG. 1 is a perspective view of a male tab and a female terminal representing one embodiment of the terminal for electrical connection according to the present invention. In FIG. 1, both of the male tab 1 and the female terminal 2 have, on their entire surfaces, electrically conductive layers consisting of an electrically conductive intermediate layer and an electrically conductive ceramic coating layer. The female terminal 2 has bent portions 21 and curved portions 22. The bent portions 21 and the curved portions 22 are usually formed by bending or curving a flat base material after forming the electrically conductive intermediate layer and the electrically conductive ceramic coating layer on the base material. However, the electrically conductive intermediate layer and the electrically conductive ceramic coating layer may be formed after bending or curving the base material. The electrically conductive intermediate layer or the electrically conductive ceramic coating layer never cracks or peels off through bending or curving.

Since the male tab 1 and the female terminal 2 have the electrically conductive ceramic coating layer, they are non-rusting and excellent in various mechanical properties such as abrasion resistance and pulled-apart resistance. Therefore, the male tab 1 and the female terminal 2 can be used for a long time in severe circumstances.

Figure 2:
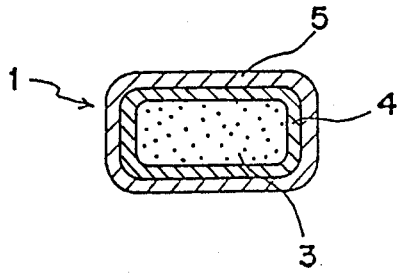
FIG. 2 is a cross-sectional view of the male tab along the line A—A′ in FIG. 1.

FIG. 2 is a cross-sectional view of the male tab along the line A—A' in FIG. 1. The male tab 1 consists of the base material 3, the electrically conductive intermediate layer 4 and the outermost electrically conductive ceramic coating layer 5. For example, the base material 3 may be made of brass, the electrically conductive intermediate layer 4 may be made of nickel, and the outermost electrically conductive ceramic coating layer 5 may be made of titanium nitride. Since the intermediate layer 4 prevents the migration of the zinc component from brass of the base material 3 to the ceramic coating layer 5, the ceramic coating layer 5 which acts as a protective layer is prevented from degrading. In this drawing, each of elements, namely, the base material 3, the intermediate layer 4 and the outermost layer 5 is illustrated in a different size from an actual size.

EFFECT OF THE INVENTION

The terminal for electrical connection according to the present invention has good mechanical properties such as abrasion resistance and corrosion resistance, is not oxidized, and has good durability since it has the electrically conductive ceramic coating layer. The good effects as mentioned above can continue after prolonged use in severe circumstances.

When the terminal for electrical connection has the electrically conductive intermediate layer, the electrically conductive ceramic coating layer does not degrade since metal atoms in the base material do not migrate into the electrically conductive ceramic coating layer. When the electrically conductive intermediate layer has higher hardness than the base material, the electrically conductive ceramic coating layer has low possibility to peel off or crack through, for example, deformation of the base material.

What is claimed is:

1. A ceramic-coated terminal for electrical connection characterized in that an electrically conductive ceramic coating layer is provided on a surface of a base material of the terminal.

2. The ceramic-coated terminal for electrical connection according to claim 1, wherein the electrically conductive ceramic coating layer is made of at least one ceramic material selected from the group consisting of titanium carbide, titanium nitride, tungsten carbide, tungsten nitride, zirconium carbide, zirconium nitride, chromium carbide and chromium nitride.

3. A ceramic-coated terminal for electrical connection wherein an electrically conductive ceramic coating layer is provided on a surface of the terminal, characterized in that an electrically conductive intermediate layer is provided between a base material of the terminal and the electrically conductive ceramic coating layer.

4. The ceramic-coated terminal for electrical connection according to claim 3, wherein the electrically conductive ceramic coating layer is made of at least one ceramic material selected from the group consisting of titanium carbide, titanium nitride, tungsten carbide, tungsten nitride, zirconium carbide, zirconium nitride, chromium carbide and chromium nitride.

5. The ceramic-coated terminal for electrical connection according to claim 3 or 4, wherein the electrically conductive intermediate layer is made of at least one material selected from the group consisting of nickel, copper, chromium, silver, gold, nickel/chromium, copper/nickel and copper/nickel/chromium.

* * * * *